US008236385B2

(12) United States Patent
Yahiaoui et al.

(10) Patent No.: US 8,236,385 B2
(45) Date of Patent: Aug. 7, 2012

(54) TREATMENT OF SUBSTRATES FOR IMPROVING INK ADHESION TO THE SUBSTRATES

(75) Inventors: Ali Yahiaoui, Roswell, GA (US); Leonard Eugene Zelazoski, Kennasaw, GA (US); Christopher Cosgrove Creagan, Marietta, GA (US)

(73) Assignee: Kimberly Clark Corporation, Roswell, GA (US)

( * ) Notice: Subject to any disclaimer, the term of this patent is extended or adjusted under 35 U.S.C. 154(b) by 494 days.

(21) Appl. No.: 11/119,386

(22) Filed: Apr. 29, 2005

(65) Prior Publication Data

US 2006/0246263 A1 Nov. 2, 2006

(51) Int. Cl.
*B05D 5/04* (2006.01)

(52) U.S. Cl. ..... 427/412; 427/372.2; 427/407.1

(58) Field of Classification Search ..... 427/299, 427/372.2, 407.1, 412
See application file for complete search history.

(56) References Cited

U.S. PATENT DOCUMENTS

| | | | | |
|---|---|---|---|---|
| 3,016,599 | A | | 1/1962 | Perry, Jr. |
| 3,098,692 | A | | 7/1963 | Gagliardi |
| 3,158,494 | A | * | 11/1964 | Tore et al. ..... 428/207 |
| 3,341,394 | A | | 9/1967 | Kinney |
| 3,655,862 | A | | 4/1972 | Dorschner et al. |
| 3,692,618 | A | | 9/1972 | Dorschner et al. |
| 3,704,198 | A | | 11/1972 | Prentice |
| 3,705,068 | A | | 12/1972 | Dobo et al. |
| 3,755,527 | A | | 8/1973 | Keller et al. |
| 3,788,804 | A | | 1/1974 | Harper, Jr. et al. |
| 3,802,817 | A | | 4/1974 | Matsuki et al. |
| 3,849,241 | A | | 11/1974 | Butin et al. |
| 3,853,651 | A | | 12/1974 | Porte |
| 3,897,204 | A | | 7/1975 | Mizuma et al. |
| 3,926,553 | A | | 12/1975 | Fuest |
| 3,961,965 | A | | 6/1976 | Zwahlen |
| 3,978,185 | A | | 8/1976 | Buntin et al. |
| 3,988,343 | A | | 10/1976 | Lilyquist |
| 3,989,453 | A | | 11/1976 | Jilla |
| 4,050,892 | A | | 9/1977 | Jilla |
| 4,064,605 | A | | 12/1977 | Akiyama et al. |
| 4,088,440 | A | | 5/1978 | Leimbacher et al. |
| 4,091,140 | A | | 5/1978 | Harmon |
| 4,100,319 | A | | 7/1978 | Schwartz |
| 4,100,324 | A | | 7/1978 | Anderson et al. |
| 4,118,531 | A | | 10/1978 | Hauser |
| 4,136,218 | A | | 1/1979 | Nischwitz et al. |

(Continued)

FOREIGN PATENT DOCUMENTS

EP 0480362 A2 4/1992

(Continued)

OTHER PUBLICATIONS

Patent Abstracts of Japan, Publication No. 04173178A, Jun. 19, 1992.

(Continued)

*Primary Examiner* — Andrew T Piziali
(74) *Attorney, Agent, or Firm* — Dority & Manning, P.A.

(57) ABSTRACT

A polymeric substrate primed with a treatment composition to allow better receptivity of an ink composition, and method for making the same, is generally disclosed. More specifically, the polymeric substrate can be a hydrophobic polymeric substrate such as comprising polyolefins, which exhibits better ink adhesion and rub resistance when pretreated with a treatment composition of the present invention.

20 Claims, 2 Drawing Sheets

U.S. PATENT DOCUMENTS 4,210,412 A 7/1980 Yamane et al.
4,236,890 A 12/1980 Blanchard et al.
4,243,802 A 1/1981 Landoll
4,284,410 A 8/1981 Nischwitz et al.
4,330,293 A 5/1982 Lindemann
4,340,563 A 7/1982 Appel et al.
4,369,041 A 1/1983 Dvorsky et al.
4,405,297 A 9/1983 Appel et al.
4,434,204 A 2/1984 Hartman et al.
4,441,884 A 4/1984 Baumann et al.
4,627,811 A 12/1986 Greiser et al.
4,644,045 A 2/1987 Fowells
4,663,220 A 5/1987 Wisneski et al.
4,702,742 A 10/1987 Iwata et al.
4,725,849 A 2/1988 Koike et al.
4,743,266 A 5/1988 Harper, Jr.
4,786,288 A 11/1988 Handa et al.
4,795,675 A 1/1989 Dunn, Jr. et al.
4,801,497 A 1/1989 Kono et al.
4,939,992 A 7/1990 Bird
4,940,464 A 7/1990 Van Gompel et al.
5,015,261 A 5/1991 Donenfeld et al.
5,137,773 A * 8/1992 Malhotra ..... 428/32.14
5,212,008 A 5/1993 Malhotra et al.
5,220,346 A * 6/1993 Carreira et al. ..... 347/102
5,353,706 A 10/1994 Kerle
5,382,400 A 1/1995 Pike et al.
5,403,358 A 4/1995 Aston et al.
5,405,650 A 4/1995 Boulanger et al.
5,456,982 A 10/1995 Hansen et al.
5,458,590 A 10/1995 Schleinz et al.
5,494,759 A 2/1996 Williams et al.
5,496,634 A 3/1996 Ogawa et al.
5,503,076 A 4/1996 Yeo
5,520,112 A 5/1996 Schleinz et al.
5,562,037 A 10/1996 Schleinz et al.
5,574,081 A 11/1996 Kroon
5,587,102 A 12/1996 Stern et al.
5,635,970 A 6/1997 Shirota et al.
5,660,928 A 8/1997 Stokes et al.
5,672,392 A 9/1997 De Clercq et al.
5,677,067 A 10/1997 Kojima et al.
5,686,951 A 11/1997 Koike et al.
5,695,855 A 12/1997 Yeo et al.
5,698,478 A 12/1997 Yamamoto et al.
5,709,976 A 1/1998 Malhotra
5,714,270 A 2/1998 Malhotra et al.
5,759,673 A 6/1998 Ikezawa et al.
5,814,567 A 9/1998 Yahiaoui et al.
5,817,843 A 10/1998 Masuda et al.
5,858,514 A 1/1999 Bowers
5,897,694 A 4/1999 Woolf
5,919,559 A 7/1999 Nakano et al.
5,944,355 A * 8/1999 Rich et al. ..... 283/81
5,945,175 A 8/1999 Yahiaoui et al.
5,958,561 A 9/1999 Held
5,966,145 A 10/1999 Miura et al.
6,001,137 A 12/1999 Alfekri et al.
6,017,832 A 1/2000 Yahiaoui et al.
6,028,016 A 2/2000 Yahiaoui et al.
6,051,036 A 4/2000 Kusaki et al.
6,074,761 A 6/2000 Wang et al.
6,096,412 A 8/2000 McFarland et al.
6,096,418 A 8/2000 Sato et al.
6,103,364 A 8/2000 Harris et al.
6,117,606 A 9/2000 Macholdt et al.
6,120,888 A 9/2000 Dolsey et al.
6,127,037 A 10/2000 Sargeant et al.
6,132,879 A 10/2000 Tamura et al.
6,139,939 A 10/2000 Haruta et al.
6,142,619 A 11/2000 Miura et al.
6,150,289 A 11/2000 Chen et al.
6,156,384 A 12/2000 Hutter et al.
6,204,208 B1 3/2001 Krzysik et al.
6,225,381 B1 5/2001 Sharma et al.
6,241,787 B1 6/2001 Nigam
6,242,041 B1 6/2001 Katoot et al.
6,248,432 B1 6/2001 Moronuki et al.
6,325,501 B2 12/2001 Kuwabara et al.
6,368,689 B1 4/2002 Sledge et al.
6,371,610 B1 4/2002 Nakamura et al.
6,372,329 B1 * 4/2002 Graczyk et al. ..... 428/32.24
6,394,597 B1 5/2002 Koike et al.
6,450,633 B1 9/2002 Kronzer
6,458,449 B1 10/2002 Parent et al.
6,477,948 B1 11/2002 Nissing et al.
6,479,412 B1 11/2002 Alfekri et al.
6,503,977 B1 1/2003 Branham et al.
6,506,478 B1 * 1/2003 Schulz ..... 428/32.25
6,513,924 B1 2/2003 Goldberg et al.
6,534,155 B1 3/2003 Sharma et al.
6,555,213 B1 * 4/2003 Koneripalli et al. ..... 428/304.4
6,589,633 B1 7/2003 Ino et al.
6,592,218 B1 7/2003 Salsman
6,680,108 B1 1/2004 Majumdar et al.
6,698,874 B2 3/2004 Katsuki
6,698,880 B1 3/2004 Campbell et al.
6,699,537 B2 3/2004 Branham et al.
6,703,086 B2 3/2004 Kronzer et al.
6,709,763 B2 3/2004 Fanta et al.
6,749,641 B2 6/2004 Cates et al.
6,786,588 B2 9/2004 Koyano et al.
6,793,333 B2 9/2004 Brignone et al.
6,824,650 B2 11/2004 Lindsay et al.
6,838,132 B1 1/2005 Iguchi et al.
6,838,498 B1 1/2005 Bagwell et al.
6,844,034 B2 * 1/2005 Touhsaent ..... 428/32.1
6,887,805 B2 5/2005 Chenel
6,893,535 B2 5/2005 Hermans et al.
6,896,767 B2 5/2005 Wilhelm
6,905,732 B1 * 6/2005 Dunshee et al. ..... 427/372.2
7,238,410 B2 * 7/2007 Kronzer ..... 428/195.1
2003/0050618 A1 3/2003 Kondo et al.
2003/0061669 A1 4/2003 Tsui
2003/0103129 A1 * 6/2003 Tanaka et al. ..... 347/105
2003/0118816 A1 6/2003 Polanco et al.
2003/0203162 A1 10/2003 Fenwick et al.
2004/0091692 A1 5/2004 Parrinello et al.
2004/0118530 A1 6/2004 Kressner et al.
2004/0121675 A1 6/2004 Snowden et al.
2004/0125184 A1 7/2004 Sharma et al.
2004/0163784 A1 8/2004 Urlaub et al.
2004/0194234 A1 10/2004 Bartl et al.

FOREIGN PATENT DOCUMENTS

EP 0753621 A1 1/1997
EP 0704316 B1 4/1998
EP 0842786 A1 5/1998
EP 0643590 B1 9/1998
EP 0771670 B2 2/2002
GB 440559 A 12/1935
GB 1444426 A 7/1976
GB 1587930 A 4/1981
GB 2376246 A 12/2002
WO WO9701448 1/1997
WO WO9831318 7/1998
WO WO9919410 4/1999
WO WO9933669 7/1999
WO WO0012809 3/2000
WO WO0041821 7/2000
WO WO0056972 9/2000
WO WO0059721 10/2000
WO WO0069950 11/2000
WO WO0076445 12/2000
WO WO0076446 12/2000
WO WO0114627 3/2001
WO WO0147700 A1 7/2001
WO WO02051644 7/2002
WO WO02055294 7/2002
WO WO02066731 8/2002
WO WO2004061200 7/2004

OTHER PUBLICATIONS

Patent Abstracts of Japan, Publication No. 04272278A, Sep. 29, 1992.
Patent Abstracts of Japan, Publication No. 06287870A, Oct. 11, 1994.
Patent Abstracts of Japan, Publication No. 09268482A, Oct. 14, 1997.
Patent Abstracts of Japan, Publication No. 2002/069812A, Mar. 1, 2001.
Patent Abstracts of Japan, Publication No. 2001/181932A, Mar. 7, 2001.
International Search Report Mailed Jul. 3, 2007—5 pages.

* cited by examiner

TREATMENT OF SUBSTRATES FOR IMPROVING INK ADHESION TO THE SUBSTRATES

BACKGROUND OF THE INVENTION

Polymers are used extensively to make a variety of products which include blown and cast films, extruded sheets, injection molded articles, foams, blow molded articles, extruded pipe, monofilaments, fibers, and nonwoven fabrics. Many polymers that are used to form these products, such as polyolefins, are naturally hydrophobic or apolar and are chemically inert. For many uses, hydrophobicity is a disadvantage, particularly when printing with aqueous-based inks having a relatively higher surface tension than the surface energy of the polymeric substrate. For example, aqueous-based inks can have a surface tension of greater than or equal to above 45 dynes/cm, while the polymeric substrate can have a surface tension of about 30 dynes/cm. While substrate hydrophobicity may not be an issue with lower surface tension inks or solvent-based inks, still the apolar nature of the polymeric substrate will not promote good adhesion of these inks, either aqueous or solvent based, to the polymeric substrates, resulting in printed graphics that will easily rub off when exposed to shear.

Typically, the polymers used to form these products are poorly polar resulting in them being non-conducive to adhere most common ink compositions applied to the surface of the polymeric substrate. Also, these polymers are typically non-absorbent and unable to form a mechanically strong network with the ink composition after it is applied to the polymeric substrate.

Hydrophobic polymers, including polyolefins, such as polyethylene and polypropylene, can be used to manufacture polymeric fabrics which are employed in the construction of packaging articles and disposable absorbent articles such as diapers, feminine care products, incontinence products, training pants, wipes, and so forth. Such polymeric fabrics are often nonwoven fabrics prepared by, for example, processes such as melt blowing, carding, co-forming, spunbonding, and combinations thereof.

Absorbent articles, especially personal care absorbent articles, such as diapers, training pants, and swimming pants, typically include an outer cover made from a nonwoven polymeric fabric. The outer cover of diapers, training pants, and swimming pants, for example, are difficult to print on in a fast and economic manner that is amiable to efficient machine production. More particularly, it is difficult to get good ink adhesion to such hydrophobic polymeric substrates. In particular, it has been difficult to print colored graphics that are crockfast onto the polymeric substrates, especially through conventional printing methods such as a flexographic process. It has been even more difficult to print colored graphics that are crockfast onto the polymeric substrates via digital printing processes and digital inks.

With training pants, such as PULLUPS brand training pants manufactured by the assignee of record, Kimberly-Clark Corporation, it is desirable to make the product as aesthetically attractive and appealing to the consumer as possible to wear during training of the child to progress from diapers to underwear. One means to make this product more appealing is to print in bright colors a number of designs on the exterior cover of the training pant. However, in the past, it has been difficult to directly print colored inks onto the exterior surface of the training pant without costly processes, such as over-lacquers to protect the ink from abrasion. As a result, it has typically been necessary to print these colored designs on an underlying film layer and then superimpose the polymeric substrate, as an added layer over the top of the printed film layer such that the color designs can be viewed, albeit somewhat diffusely, through the polymeric substrate.

Accordingly, there is a need to improve adhesion of inks to outer covers on diapers, training pants, swimming pants, and other products that incorporate hydrophobic substrates. Also, a need exists for a process in which designs can be printed directly on the exterior surfaces of absorbent articles.

A need also exists to improve color vibrancy of the printed inks to outer covers on diapers, training pants, swimming pants, and other products that incorporate hydrophobic substrates. It follows that a need exists for a method to treat hydrophobic substrates so that ink usage is minimized while providing good color vibrancy and good ink rub resistance.

SUMMARY OF THE INVENTION

Generally, the present disclosure is directed to, in one embodiment, a printed polymeric material comprising a polymeric substrate, a surface treatment, and an ink composition. The surface treatment may be applied to at least a portion of the polymeric substrate. In one embodiment, the surface treatment comprises a polyurethane alone or in combination with a cationic species, such as a cationic polymer. In some embodiments, the surface treatment can also include other additives, such as inorganic particles, organic particles, surfactants, pH modifiers, crosslinkers, binders, and any combination or mixture thereof.

In one embodiment, the surface treatment can be applied to the polymeric material in an amount of greater than about 0.2% of the basis weight of the polymeric material, such as greater than about 0.4%. In one particular embodiment, the surface treatment can be applied to the polymeric material in an amount of from about 0.2% to about 0.5% of the basis weight of the polymeric substrate.

The polymeric substrate can be a hydrophobic polymeric substrate. For example, the polymeric substrate can comprise a nonwoven web or laminate comprising hydrophobic polymeric fibers, such as polyolefin fibers. In one embodiment, the polymeric substrate can define a polymeric substrate surface that has been functionalized prior to the application of the surface treatment. The polymeric substrate can be a component of, for example, a personal absorbent product, such as the outer layer of a diaper.

Any ink composition can be utilized according to the present disclosure, including aqueous inks, solvent based inks, and mixtures thereof. Also, different methods of printing both the surface treatment and the treatment composition may be utilized, including, for example, digital printing processes and flexographic printing processes.

The printed polymeric substrate of the present disclosure can have a crockfastness rating of greater than about 4.5, such as greater than about 4.6. For example, in one embodiment, the printed polymeric substrate can have a crockfastness rating of greater than about 4.8.

The present disclosure is also generally directed to the process of printing a pattern onto a material. Generally, one of the processes disclosed comprises providing a polymeric substrate, coating at least a portion of the polymeric substrate with a surface treatment, drying the surface treatment and printing an ink composition onto the surface treatment.

Additional objects and advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the invention without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

DEFINITIONS

As used herein:

"Polymeric substrate" includes any shaped article, provided it is composed, in whole or in part, of a polymeric material. For example, the polymeric substrate may be a sheet-like material, such as a sheet of a foamed material. The polymeric substrate may also be a fibrous fabric, such as a film or a woven or a nonwoven web or fabric. Nonwoven webs include, but are not limited to, meltblown webs, spunbonded webs, carded webs, or airlaid webs. Also, the polymeric substrate can be a laminate of two or more layers of sheet-like material.

"Hydrophobic polymer" means any polymer resistant to wetting, or not readily wet, by water, i.e., having a lack of affinity for water.

"Polyolefin" means a polymer prepared by the addition polymerization of one or more unsaturated monomers which contain only carbon and hydrogen atoms. Examples of such polyolefins include polyethylene, polypropylene, and so forth. In addition, such term is meant to include blends of two or more polyolefins and random and block copolymers prepared from two or more different unsaturated monomers. The polyolefin may contain additives as is known or customary in the art. For example, the polyolefin may contain pigments, opacifiers, fillers, delustrants, antioxidants, antistatic agents, stabilizers, oxygen scavengers, ink receptive additives, and so forth.

BRIEF DESCRIPTION OF THE FIGURES

A full and enabling disclosure of the present invention including the best mode thereof, directed to one of ordinary skill in the art, is set forth in the specification, which includes and makes reference to the appended figures, in which.

Figure 1:
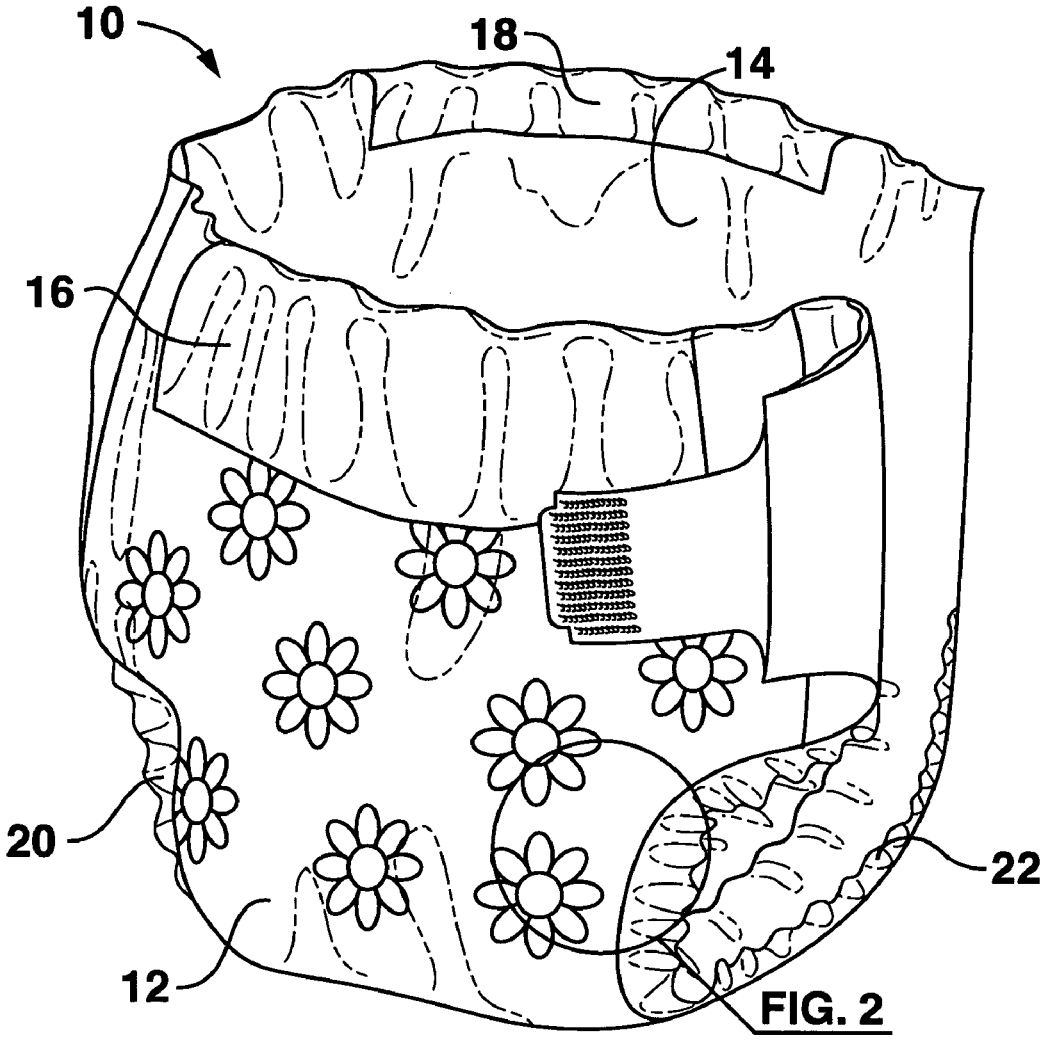
FIG. 1 is a perspective view of a diaper incorporating a printed polymeric substrate of the present invention.

Repeated use of reference characters throughout the present specification and appended drawings is intended to represent the same or analogous features or elements of the invention.

DETAILED DESCRIPTION OF THE INVENTION

Polymeric substrates are useful as components of absorbent products, personal care products, and healthcare products, such as protective garments, other medical apparel, outer covers for diapers, outer covers for training pants, outer covers for swimming pants, and so forth. Polymeric substrates and other components of such disposable products are frequently made of or from synthetic polymers, particularly polyolefin polymers such as polypropylene and polyethylene. For example, the polymeric substrate may be a nonwoven web that includes synthetic fibers, particularly hydrophobic fibers, such as polyolefin fibers. For instance, in one embodiment, the nonwoven web can comprise polypropylene fibers. In another embodiment, the nonwoven web can comprise polyethylene fibers.

Synthetic polymers, such as polyolefins, are generally hydrophobic and do not adhere well to ink compositions. This is especially true when the ink composition is aqueous-based. As such, the present invention is directed toward applying a surface treatment composition to the polymeric substrate prior to the application of an ink composition. The treated polymeric substrate exhibits better ink receptivity and better rub resistance than a non-treated polymeric substrate.

Any suitable polymeric substrate can be treated according to the present invention. For example, the polymeric substrate can comprise one or more hydrophobic polymers, such as polyolefin polymers. In one embodiment, the polymeric substrate could be used in the manufacture of a personal care product, such as a diaper. For example, in one particular embodiment, a polymeric substrate, such as a nonwoven web comprising polypropylene fibers, can be used as an outer cover of a diaper.

Figure 2:
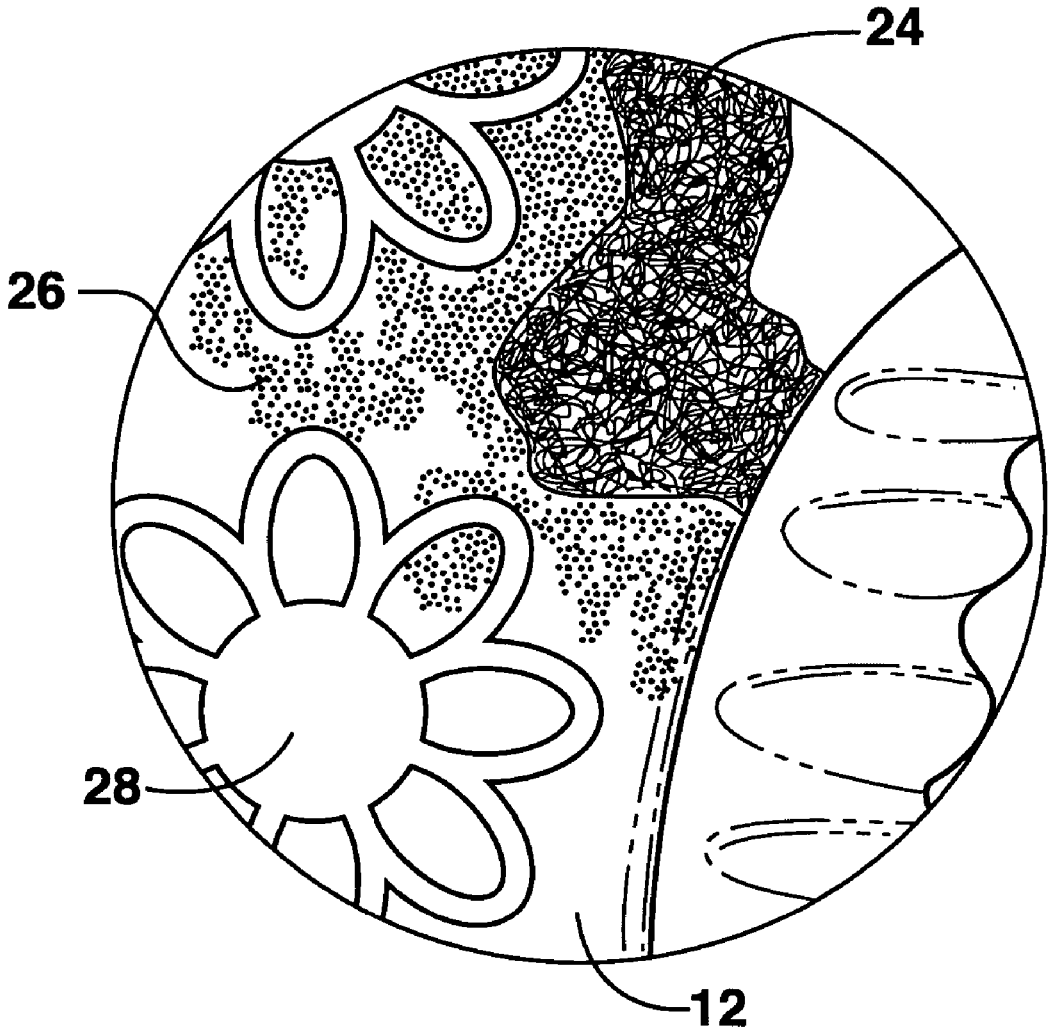
FIG. 2 is a cut-away view of a portion of the diaper incorporating a printed polymeric substrate, a treatment composition, and an ink composition.

For purposes of illustration only, FIGS. 1 and 2 depict a diaper incorporating the treated polymeric substrate of the present invention. For instance, diaper 10, as shown in FIGS. 1 and 2, includes an outer cover 12, an inner lining 14, and an absorbent structure (not shown) positioned between the outer cover 12 and the inner lining 14. As shown in FIG. 1, the diaper 10 may also include elastic waistbands 16 and 18 and elastic leg members 20 and 22.

As described above, the absorbent structure is positioned in between the outer cover 12 and a liquid permeable bodyside liner 14. The bodyside liner 14 is suitably compliant, soft feeling, and non-irritating to the wearer's skin. The bodyside liner 14 can be manufactured from a wide variety of web materials, such as synthetic fibers, natural fibers, a combination of natural and synthetic fibers, porous foams, reticulated foams, apertured plastic films, or the like. Various woven and nonwoven fabrics can be used for the bodyside liner 14. For example, the bodyside liner can be made from a meltblown or spunbonded web of polyolefin fibers. The bodyside liner can also be a bonded-carded web composed of natural and/or synthetic fibers.

As better shown in the cut-away depiction of FIG. 2, outer cover 12 comprises a polymeric substrate 24, and surface treatment composition 26 which has been applied to polymeric substrate 24 prior to applying an ink composition 28. By applying the treatment composition 26 to the polymeric substrate 24, the polymeric substrate 24 exhibits better receptivity to ink compositions 28. Once applied, the printed polymeric substrate exhibits improved crockfastness, overall printing quality, gloss retention, and vibrancy for a broad range of inks. Also, enhanced ink drying can be achieved by the products and processes of the present disclosure, enabling faster line speeds and high speed printing.

Further, applying a surface treatment composition to the polymeric substrate allows for better ink-use efficiency because less ink can be applied to a surface of the treatment composition than an untreated polymeric substrate surface, while providing good color and graphic vibrancy. Without wishing to be bound by theory, it is believed that the treatment composition allows the ink, once applied, to remain on the surface of the polymeric substrate. On the other hand, a non-treated polymeric substrate allows the ink to be more readily absorbed into the polymeric substrate, requiring more ink to be applied.

Improved surface energy is also exhibited with the treated polymeric substrate. The surface energy can be, for instance, greater than about 40 dynes per cm, such as greater than about 50 dynes per cm. By comparison, without the treatment composition, the printed polymeric substrate exhibits around a 30 dynes per cm surface energy.

The treated polymeric substrates of the present invention exhibit better rub resistance, measurable by a higher crockfastness rating ("CR"), than other non-treated printed polymeric substrates. Crockfastness is a parameter that shows the degree of durability or adhesion of the ink to the substrate. Crockfastness is measured on a scale from 1 to 5, with 5 being the highest, of the resistance of the material to the transfer of color to another material. The present inventors have found that by treating the polymeric surface with the treatment composition of the present invention prior to applying the ink composition, the final treated printed polymeric substrate can exhibit an improved crockfastness of greater than about 4.0. For example, in some embodiments, the printed polymeric material according to the present invention exhibits a crockfastness rating of greater than about 4.5, such as greater than about 4.6. For example, in one embodiment, the printed polymeric material of the present invention can exhibit a crockfastness rating of about 4.8 to about 5.

In one embodiment, the treatment composition can comprise an adhesion promoter. The treatment composition can be a solution, dispersion, suspension, emulsion, or the like. As used hereinafter, the term "solution" is used broadly to include single phase solutions as well as two or more phase solutions, such as emulsions, suspensions, or dispersions.

For instance, the adhesion promoter can comprise a polyurethane. For example, the polyurethane can be an hydrophilic polyurethane. The polyurethane can also be non soluble in an organic solvent, such as in n-propanol, ethyl acetate, and the like. Also, the polyurethane can be, for example, a nonionic polyurethane, so that it is colloidally stable over a wide range of pH values and is insensitive to cationic additives. Furthermore, for example, the polyurethane can be an aliphatic polyether waterborne urethane polymer or an aliphatic polyester waterborn urethane polymer. The polyurethane can also be a solvent-based system. In some embodiments, the polyurethane can be co-polymerized with other functional polymers such as, for example, acrylic polymers, styrenic polymers, and the like.

For example, the polyurethane can be one of the polyurethanes sold by Noveon, Inc. located in Cleveland, Ohio, under the trade names PERMAX 20, PERMAX 200, PERMAX 100, PERMAX 120. SANCURE 20025, or SANCURE 2003. For example, it is believed that PERMAX 200 is an aliphatic polyether waterborne urethane polymer. Other polyurethanes that can be used according to the present disclosure are those polyurethanes made by Stahl, Inc. of Peabody, Mass. and sold under the trade name of Permuthane, which are solventborne and can be aliphatic or aromatic.

The base solution comprising a polyurethane can be up to about 50% solids, such as from about 35% to about 50% solids, or as low as about 1% solids depending on the treatment application method. For example, in one embodiment, the base solution comprising a polyurethane can be from about 40% to about 48% solids. As such, the treatment composition comprising a polyurethane can be up to about 50% by weight polyurethane, such as from about 1% to about 25% by weight polyurethane. For example, in some embodiments, the polyurethane can be present in the treatment composition in an amount less than about 3.5% by weight, such as about 2% by weight. In other embodiments, polyurethane can be present in the treatment composition in an amount of about 20% by weight polyurethane.

The viscosity of the treatment composition comprising a polyurethane can range from about 150 centipoise to about 1500 centipoise, such as about 200 centipoise to about 1000 centipoise.

In another embodiment, the treatment composition can comprise an adhesion promoter and a cationic polymer. The cationic polymer can be, for example, a derivatized polyvinyl pyrrolidone (such as Polyplasdone INF-10 sold by ISP of Wayne, N.J.), a quaternized copolymer of vinyl pyrrolidone and dimethylaminoethyl methacrylate (such as LUVIXQUAT sold by BASF), an ammonium salt of styrene-acrylic copolymer (such as EKA SP AA20 sold by EKA AKZO Nobel of Rome, Ga.), a cationic polyethylene imine epichlorohydrin (such as KYMENE 557LX and Reten 204LS sold by Hercules of Wilmington, Del.), and the like. In other embodiments, the cationic polymer can be a further modified, functionalized cellulosic material.

For instance, the cationic polymer can be a cellulose compound derivatized with a quaternary ammonium group, such as the compound sold under the trade name Crodacel QM by Croda, Inc. of Parsippany, N.J. In another embodiment, the cationic polymer can be blended with an ethyl hydroxyethyl cellulose, such as the derivatized cellulose sold under the trade name BERMOCOLL E230 FQ sold by AKZO Nobel of Stratford, Conn. In some embodiments, other cellulose or polysaccharide derivatives, such as chitosan, dextran, starch, agar and guar gum, and the like, can also be used. Other cationic polymers can include, but are not limited to, poly(n-butyl acrylate/2-methyloxyethyltrimethyl ammonium bromide), poly(2-hydroxy-3-methacryloxypropyltrimethylammonium chloride), poly(vinyl alcohol), N-methyl-4(4'-formylstyryl)pyridinium methosulfate acetal, all sold by Polysciences, Inc. (Warrington, Del.), or other cationic polymers made from cationic monomers sold by Ciba Specialty Chemicals including AGEFLEX mDADMAC (Diallyldimethylammonium Chloride), AGEFLEX FA1Q80MC (N,N-Dimethylaminoethyl Acrylate Methyl Chloride Quaternary), AGEFLEX FM1Q75MC (N,N-Dimethylaminoethyl Methacrylate Methyl Chloride Quaternary).

The cationic polymer can be present in an amount of up to about 10% by weight. For instance, in some embodiments, the cationic polymer can be present in an amount of from about 0.1% to about 4% by weight. For example, in one particular embodiment, the cationic polymer can be present in an amount from about 0.5% to about 2% by weight of cationic polymer.

In addition, in some embodiments, other additives can be added to the treatment composition. For example, inorganic particles can be added to the treatment composition. Inorganic particles can include, but are not limited to, clays such as LAPONITE XLG sold by Southern Clay, Inc. of Gonzales, Tex., kaolin, silica particles such as colloidal silica particles. Other additives can include, but are not limited to, organic particles (e.g. PE, PP, PTFE, PVP, and the like), proteins (e.g. casein, sodium casein, and the like), surfactants (e.g. alkyl polyglycosides, and the like), pH modifiers, crosslinkers, binders, and the like. For example, ammonia can be added to the treatment composition to adjust the pH to a desired level. In another embodiment, a surfactant, such as the compound sold under the trade name Hydropalat 88 (a modified ester of sulfocarboxylic acid) made by Cognis, Corp. of Ambler, Pa., can be added to the treatment composition to enhance the wetting and adhesion properties of the polymeric substrate.

For instance, crosslinkers may include, but are not limited to, the poly-functional aziridine crosslinker sold under the trade name XAMA 7 by Bayer Corporation of Pittsburgh, Pa., the ammonium zircomnium carbonate crosslinker sold under the trade name EKA AZC 5800M by AKZO Nobel of Rome, Ga., the polyamide epichlorohydrin sold under the trade name Polycup 289 by Hercules, Inc. of Wilmington, Del., and the like. Also, in some embodiments, particles such as calcium carbonate can be added to the treatment composition, such as the calcium carbonate sold under the trade name Calcium Carbonate XC 4900 by OMYA, Inc., North America.

The treatment composition 26 can be applied to the polymeric substrate 24 via any conventional treatment or coating techniques, including printing. For example, the treatment composition can be sprayed onto the polymeric substrate. In another embodiment, the treatment composition can be printed onto the polymeric substrate, such as by gravure or flexographic printing. For example, treatment composition 26 can be flexographically printed onto polymeric substrate 24. In other embodiments, the treatment composition can be extruded onto the polymeric substrate or foamed onto the polymeric substrate.

The amount of treatment composition that is added to the polymeric substrate can vary according to the particular application of the polymeric substrate. For example, the treatment composition can be added onto the polymeric substrate in an amount greater than about 0.2%, such as greater than about 0.4% of the basis weight of the polymeric substrate. In one embodiment, the treatment composition can be added on in an amount greater than about 3% of the basis weight of the polymeric substrate. In one particular embodiment, the treatment composition can be applied to the substrate in an amount from about 0.1% to about 20% of the basis weight of the polymeric substrate.

The treatment composition can be applied to the entire polymeric substrate surface or only to a portion of the polymeric substrate surface. For example, in one embodiment, the treatment composition can be applied to only the areas of the polymeric substrate surface where the ink composition will be applied. For instance, the treatment composition can be applied to the polymeric substrate surface in substantially the same pattern as the ink composition will be applied.

Several advantages can be realized when applying the treatment composition to only the portion of the polymeric substrate surface that will be printed on. For instance, significant cost savings, in terms of the amount of treatment composition used, can be realized because less treatment composition is applied. Also, the non-treated areas of the polymeric substrate surface will not have any changed topographical features or properties, such as, for example, aesthetics, drapability, and the "fastening anywhere" feature of a conventional hook-and-loop type fastener.

In some embodiments, the treatment composition can be applied to the polymeric substrate and allowed to dry prior to the application of an ink composition onto the polymeric substrate. Any method of drying the treatment composition can be utilized. For example, the treatment composition can be simply dried by air, or hot air. In other embodiments, a lamp or lamps, such as an IR lamp, can be utilized to dry the treatment composition. In other embodiments, microwave radiation drying may be utilized. In other embodiments, the treatment composition is only minimally dried and is allowed to interact with the ink ingredients (e.g. solvent, binder, colorant, and others) in such a way that the interaction between the treatment solvent and the ink ingredients causes the ink to collapse, to coagulate in place, or to crosslink. Thus, in this embodiment, a more cohesively strong printed ink may be yielded.

In other embodiments, the ink composition can comprise components of the treatment composition such that when the ink composition is applied to the polymeric substrate, the adhesion promoter included within the ink composition allows for good ink receptivity to the polymeric substrate. For instance, in one particular embodiment, an adhesion promoter, such as polyurethane, can be combined with the ink composition. However, when the polyurethane is included in the ink composition, it is generally preferred that the ink composition further comprising an adhesion promoter be flexographically printed onto the polymeric substrate. Also, in this embodiment, the ink composition is either an aqueous based or a solvent based solution such that the adhesion promoter, such as a polyurethane, is more readily dissolved or homogeneously dispersed into the solution. Also, in another embodiment, the ink composition is preferred to be an aqueous solution because of significantly reduced odor and volatile organic compounds.

Ink compositions can be applied in a solution form, such as in an aqueous solution, an organic solvent solution, or in mixed aqueous/organic solvent systems. Typically, aqueous based ink compositions are most widely used with digital printing, while solvent based inks are most widely used with flexographic printing. However, solvent based inks can also be used with digital processes, and water based inks are commonly used with flexographic printing. In the digital ink processes, the inks are difficult to formulate because the ink composition is constrained to a choice of ingredients. The digital inks and digital processes have narrow tolerances in terms of pH, viscosity, surface tension, purity, and other physical and chemical properties. Also, ink compositions used in digital ink processes typically have a low solid content which can create difficulty in drying the ink composition onto the polymeric substrate, especially in the high speed printing process. One means to enhance drying in such case is to incorporate particles into the treatment composition to create a porous coating on the substrate, such as calcium carbonate, for example. The capillary structure of the coating can wick the ink solvent away from the printed area and can spread over a larger area, allowing faster drying. Capillarity is commonly and mathematically described by Laplace Equation as show below:

$$\Delta P=\gamma\cdot\cos\theta/r,$$

where ΔP is the capillary pressure, γ is the surface tension of the ink, θ is the contact angle at the ink/substrate interface, and r is the radius of the capillary.

Solvent based ink solutions are widely used for flexographically printing onto polymeric substrates, such as polyolefins. However, solvent based ink compositions are less commonly used with digital ink processes, such as ink jet printing.

In the past, aqueous based ink compositions have not been easily applied with strong adhesion to polymeric substrates, particularly hydrophobic polymeric substrates, such as polyolefins.

However, the present inventors have found, surprisingly, that by treating the polymeric substrate with the treatment composition of the present invention, the polymeric substrate exhibits much improved aqueous based ink composition receptivity. Without wishing to be bound by theory, it is believed that the introduction of a polar functionality to the polymeric substrate creates stronger bonding between the polymeric substrate and the ink composition, which leads to better ink receptivity and better rub resistance, crockfastness, vibrancy, and gloss retention.

Various printing processes can be utilized according to the present disclosure, such as, for example, digital printing, flexographic printing, offset printing, gravure printing, and the like. In some embodiments, the polymeric substrate may be printed on by a combination of processes. For example, the polymeric substrate may first be printed by a flexographic process to impart a base color, then specific graphics may be printed onto the base color by a digital printing process.

Digital printing, for example, includes the process of ink jet printing, and the like. The ink jet printer can be, for example, a piezoelectric printer, a valve jet printer, or a thermal printer. Ink jet technology includes a device known as an ink jet print head that has a plurality of orifices. A substance, such as in ink composition, may be expelled from one or more of these orifices thus exiting the print head of the ink jet printer. Drops of the substance then travel a throw distance between the print head and the web or other surface onto which the substance is to be applied. The orifices of the print head may be aligned in a single row or may be formed having various patterns. The substance may be expelled from these orifices either simultaneously or through selected orifices at any given time.

Digital printing generally involves a computer controlling the print head movement and function. The computer can control the print head to print stored patterns and designs. One particularly preferred ink jet process is the Continuous Ink Jet ("CIJ") Process of Kodak Versamark of Dayton, Ohio. The CIJ Process is more compatible with high speed printing than, for example, a drop-on-demand ("DOD") process.

The substance can be applied to the sheet in a discontinuous manner such that the sheet includes treated areas where the droplets reside and untreated areas. Thus, the ink jet printers can apply an ink composition to a surface in a controlled manner. As one skilled in the art would recognize, it is generally preferred that an aqueous ink composition be used in conjunction with a digital printer. However, the term "aqueous based inks" or aqueous based ink compositions" is meant to include those inks that have a solvent system that is predominately water and does not exclude solvents systems having some other solvents included, for example up to about 50% solvent, such as up to about 25% solvent. For example, in aqueous based inks, other solvents, such as alcohols, can be included in the system to help solubility of some of the ink components or additives as well as to ease drying of the ink.

The ink composition 28 can be printed onto treatment composition 26 in any pattern. For example, FIGS. 1 and 2 depict ink composition 28 printed as a flowery design on treatment composition 26. However, the exact shape or design formed by ink composition 28 can vary according to the particular artwork design desired to be printed onto treatment composition 26.

The diaper 10 as shown in FIGS. 1 and 2 can be made from various materials. For example, the outer cover 12 may be made from a polymeric substrate 24. For instance, the polymeric substrate can be substantially liquid impermeable, and can be elastic, stretchable or nonstretchable. The outer cover 12 can be a single layer of liquid and permeable material, or may include a multi-layered laminate structure in which at least one of the layers is liquid and permeable. For instance, the outer cover 12 can include a liquid permeable outer layer and a liquid impermeable inner layer that are suitably joined together by a laminate adhesive.

For example, the layers may be independently selected from the group consisting of meltblown webs and spunbonded webs. However, other sheet-like materials such as films or foams may be used in addition to, or instead of, meltblown and spun-bonded webs. In addition, the layers of the laminate may be prepared from the same polymeric material or different polymeric materials. For example, in one particular embodiment, the polymeric substrate can be an adhesively spunbond-film laminate.

Methods of making films, foams and nonwoven fabrics from synthetic polymers, are well known. Films, foams, nonwoven webs and other substrates generally may be prepared by any known means. As a practical matter, however, the films, nonwoven webs and the fibers that make up nonwoven webs usually will be prepared by a melt-30 extrusion process and formed into a film or fibrous web, such as a nonwoven web. The term "melt-extrusion process" as applied to a nonwoven web is meant to include a nonwoven web prepared by any melt-extrusion process for forming a nonwoven web in which melt-extrusion to form fibers is followed by web formation, typically concurrently, on a porous support. The term includes, among others, such well-known processes as meltblowing, coforming, spunbonding, and so forth.

Other methods for preparing nonwoven webs are, of course, known and may be employed. Such methods include air laying, wet laying, carding, and so forth. In some cases it may be either desirable or necessary to stabilize the nonwoven fabric by known means, such as thermal point bonding, through-air bonding, and hydroentangling. In addition to nonwoven webs, the hydrophobic polymer fibers may be in the form of continuous filaments or staple fibers, as well as woven or knitted fabrics prepared from such continuous filaments or staple fibers.

In one embodiment, the liquid permeable outer layer of the outer cover 12 may be a spunbond polypropylene nonwoven web. The spunbond web may have, for instance, a basis weight of from about 15 gsm to about 25 gsm. The inner layer, on the other hand, can be both liquid and vapor impermeable, or can be liquid impermeable and vapor permeable. The inner layer is suitably manufactured from a thin plastic film, although other flexible liquid impermeable materials may also be used. The inner layer prevents waste material from wetting articles such as bedsheets and clothing, as well as the wearer and caregiver. A suitable liquid impermeable film may be a polyethylene film having a thickness of about 0.2 mm.

A suitable breathable material that may be used as the inner layer is a microporous polymer film or a nonwoven fabric that has been coated or otherwise treated to impart a desired level of liquid impermeability. Other "non-breathable" elastic films that may be used as the inner layer include films made from block copolymers, such as styrene-ethylene-butylene-styrene or styrene-isoprene-styrene block copolymers.

Furthermore, the nonwoven web may include bicomponent or other multicomponent fibers. Exemplary multicomponent nonwoven fabrics are described in U.S. Pat. No. 5,382,400 issued to Pike et al., U.S. patent application Ser. No. 10/037,467 entitled "High Loft Low Density Nonwoven Fabrics Of Crimped Filaments And Methods Of Making Same" and U.S. patent application Ser. No. 10/136,702 entitled "Methods For Making Nonwoven Materials On A Surface Having Surface Features And Nonwoven Materials Having Surface Features" which are hereby incorporated by reference herein in their entirety. Sheath/core bicomponent fibers where the sheath is a polyolefin such as polyethylene or polypropylene and the core is polyester such as poly(ethylene terephthalate) or poly(butylene terephthalate) can also be used to produce carded fabrics or spunbonded fabrics. The primary role of the polyester core is to provide resiliency and thus to maintain or recover bulk under/after load. Bulk retention and recovery plays a role in separation of the skin from the absorbent structure. This separation has shown an effect on skin dryness. The combination of skin separation provided with a resilient structure along with a treatment such of the present invention can provide an overall more efficient material for fluid handling and skin dryness purposes.

In one embodiment, the polymeric substrate can be a functionalized polymeric substrate. For example, the polymeric substrate can be functionalized on the surface of the polymeric substrate, such as oxidized on the polymeric substrate's surface. Any means for functionalizing the polymeric substrate can be used, such as, for example, Corona discharge, plasma discharge, flame treatment, o-zone treatment, or the like. These processes can be performed at various atmospheric pressures.

For example, Corona treatment, which is known in the art of plastic films, generally describes the process of applying an electrical discharge between two narrowly spaced electrodes obtained under atmospheric pressure from a high voltage current. The electrical field generated by the electrodes excites the gas molecules (air) and dissociates some of those molecules to generate a glow of highly energetic species of ions, radicals, metastables and photons. When a polymeric substrate, such as a polyolefin, is passed between the two electrodes and is exposed to the glow of active species, changes occur to the polymeric substrate's surface, which usually results in surface oxidation or addition of polar functionalities on the polymeric substrate's surface. These polar functional groups have a strong chemical affinity to the polar chemicals in both the treatment composition as well as in the ink compositions, which results in improved adhesion. Similarly, the more polar polymeric substrate's surface results in an increased surface energy that correlates with improved wettability. For example, the corona treatment may be applied at a level of about 2-50 watts per square foot of web per minute, preferably about 15-40 watts per square foot per minute, more preferably about 8-12 watts per square foot per minute.

Other methods of generating polar groups o the polymeric substrate's surface may also be employed, for example, a plasma technique under low pressures or atmospheric conditions and under various chemical environments, such as helium, argon, nitrogen, oxygen, carbon dioxide, ammonia, acetylene, and the like, and any mixture or combination thereof. Plasma treatment is mechanistically very similar to corona with the exception that a variety of gases can be injected into the glow discharge to modify the polymeric substrate with a broader range of functional groups.

Functionalization, such as oxidation, of the polymeric substrate's surface generally imparts a functional group to a polymeric substrate, such as a polyolefin. The polar functions include, for example, hydroxyls, carbonyls, amines, amides, and others, and any combination thereof. Methods of subjecting a material to functionalization and oxidation are well known by those skilled in the art, including those methods and processes described in U.S. Pat. No. 5,945,175 issued to Yahiaoui, et al, and assigned to Kimberly-Clark Worldwide, Inc, the disclosure of which is herein incorporated by reference in its entirety.

While the present subject matter has been described in detail with respect to specific embodiments thereof, it will be appreciated that those skilled in the art, upon attaining and understanding of the foregoing may readily produce alterations to, variations of, and equivalents to such embodiments. Accordingly, the scope of the present invention is by way of example rather than by way of limitation, and the subject disclosure does not preclude inclusion of such modifications, variations, and/or additions to the present subject matter as would be readily apparent to one of ordinary skill in the art.

Reference now will be made to various embodiments of the invention, one or more examples which are set forth below. Each example is provided by way of explanation of the invention, not as a limitation of the invention. In fact, it will be apparent to those skilled in the art that various modifications and variations may be made of this invention without departing from the scope or spirit of the invention.

EXAMPLES

Embodiments of the present disclosure set forth in these examples are separated by the method or process used for printing the ink composition on the treatment composition.

In all of the Flexographic examples, the polymeric substrate tested was an adhesively-bonded spun-bond film laminate ("aSFL") comprising a polypropylene spunbond adhesively-bonded to a polyethylene film.

The crockfastness of the printed polymeric substrates was determined as follows. Crockfastness refers to the transfer resistance of ink from the printed polymeric substrate to another surface (e.g. apparel) in contact with the printed polymeric substrate. A modification of the ASTM method F 1571-95 using a Sutherland Ink Rub Tester, Serial number R 3119 manufactured by the Danilee Company of San Antonio, Tex., was used to determine the crockfastness of the polymeric substrate examples of the present disclosure.

The ASTM method was modified in that two 1"×2" rubber pads (also available from the Danilee Company) were applied at the ends, one pad at each end, of the bottom surface of the 4 pound weight measuring 2" by 4" so that a stress of 1 pound per square inch (psi) was achieved across the pads.

The second modification of the standard ASTM method was, instead of using a microcloth available from Buehler, a 80×80 count bleached muslin cloth, the Crockmeter Cloth #3 available from Testfabrics, Inc., having offices in Pennsylvania, was used to rub against the printed polymeric substrate. It is of note that the ASTM is identified as being intended to present a procedure for measuring the abrasion resistance and smudge tendency of typewritten and impact written images; however, in the modified test method described herein, it was used to test images produced by digital and flexographic printing processes.

The procedure was also modified such that the tester ran for 40 cycles, rather than 10. The modified method also includes a visual comparison of the color which was transferred onto the muslin cloth to the AATCC 9-Step Chromatic Transference Scale (American Association of Textile Chemists and Colorists, Research Triangle Park, N.C.) so as to determine a crockfastness rating between 1 and 5. A rating of 5 indicates no transfer of color on the muslin cloth.

Examples For Flexographic Printing Processes

Both solvent-based and aqueous-based ink compositions can be printed onto a polymeric substrate through flexographic printing processes. As such, the following flexographic printing examples are separated further into aqueous-based ink compositions and solvent-based ink compositions.

Flexographically Printed Aqueous-Based Ink Compositions

For aqueous-based ink compositions, the following flexographic press conditions were used to install the samples. The flexographic printing press which was used was a 10-inch Mark Andy 4150, six-color pilot flexographic printing press available at the Center of Technical Excellence of AKZO Nobel Inks of Plymouth, Minn. The run speed was at about 135 feet per minute.

The primer systems set forth in Table 1 were utilized in different samples as shown in Table 3.

TABLE 1

| Treatment Compositions | |
|---|---|
| Primer #1 | Permax 200 (20 wt %) |
| Primer #2 | Permax 200 (20 wt %) + XAMA 7 crosslinker (1 wt %)<br>Note: pH adjusted to 10.00 with ammonia |
| Primer # 3 | Permax 200 (20 wt %) + Crodacel QM (2 wt %) +<br>Laponite XLG (1 wt %) + XAMA 7 crosslinker (1 wt %)<br>Note: pH = 5.6 initially<br>pH adjusted to 10.00 with ammonia |

As used in Table 1 above, Permax 200 sold by Noveon of Cleveland, Ohio, is believed to be an alphatic polyether waterborne urethane polymer. XAMA 7 sold by Bayer Corporation of Pittsburgh, Pa., is believed to be a poly-functional aziridine crosslinker. Crodacel QM sold by Croda, Inc. of Parsippany, N.J., is believed to be a quaternary ammonium cellulose salt. Laponite XLG sold by Southern Clay, Inc. of Gonzales, Tex., is believed to be a hydrous sodium lithium magnesium silicate.

The following ink compositions of Table 2 were utilized in the flexographic printing samples as shown in Table 3. All of the ink listed in Table 2 are listed by their respective trade name as sold by Akzo Nobel Inks ("ANI") of Plymouth, Minn.

TABLE 2

| Aqueous-Based Ink Compositions | | |
|---|---|---|
| | Ink Composition Trade Names | Manufacturer |
| Ink set 1 | HMF 80071 98428 black | ANI |
| | HMF P0186 00188 brown, pH 9 | ANI |
| | HMF P2995 00189 Blue, pH 8.6 | ANI |
| | HMF P0165 00190 red, pH 8.7 | ANI |
| | HMF P0142 00190 orange, pH 8.6 | ANI |
| Ink set 2 | same inks as above + 3 wt %<br>WA1326 (PE wax) | ANI |

After applying the ink compositions to the polymeric substrate via the flexographic printing process described above, the following results were recorded.

TABLE 3

| Sample No. | Corona | Treatment Composition | Ink Composition | Crockfastness Rating |
|---|---|---|---|---|
| Control | no | none | ink set 1 | 3.5 |
| 1 | yes | #3 | Ink set 1 | 5 |
| 2 | yes | none | Ink set 1 | 4.5 |
| 3 | yes | #2 | Ink set 1 | 5 |
| 4 | yes | #1 | Ink set 1 | 5 |
| 5 | yes | none | Ink set 2 | 4.5 |
| 6 | yes | #1 | Ink set 2 | 4.5 |

TABLE 3-continued

| Sample No. | Corona | Treatment Composition | Ink Composition | Crockfastness Rating |
|---|---|---|---|---|
| 7 | yes | #2 | Ink set 2 | 4.5 |
| 8 | yes | #3 | Ink set 2 | 5 |

If indicated, a Corona treatment of 2.4 watt density (2.4 watts per sq. ft per minute) was applied to the polymeric substrate prior to applying the treatment composition.

In this example of flexographically printing aqueous ink compositions by a 10" Mark Andy 4150 printer, the printing process conditions were as follows. Station 1 was used to apply the treatment composition with an ANILOX roll of 440 lines per inch ("lpi") and 4.0 billionth cubic microns ("bcm"). Station 2 printed the HMF P0142 ink composition with an ANILOX roll of 440 lpi and 4.5 bcm. Station 3 printed the HMF P0165 ink composition with an ANILOX roll of 440 lpi and 4.0 bcm. Station 4 printed the HMF P2995 ink composition with an ANILOX roll of 550 lpi and 3.0 bcm. Station 5 printed the HMF P0186 ink composition with an ANILOX roll of 550 lpi and 3.5 bcm. Station 6 printed the HMF 80071 ink composition with an ANILOX roll of 360 lpi and 5.5 bcm.

As can be seen from the results of Table 3, the crockfastness rating of the untreated polymeric substrate laminate is about 3.5, which indicates a clearly visible ink rub off. Also, crockfastness ratings of Samples 1, 2, and 5 indicate that Corona treatment alone improves crockfastness ratings, but ink formulations with a higher wax level (such as Ink Set No. 2) do not seem to have an affect on the crockfastness ratings. However, also as shown, the best results occurred when the polymeric substrate was pretreated with a treatment composition.

Examples For Solvent-Based Flexographically Printed Inks

The solvent based inks were made by Flint Inks (Lebanon, Ohio) and sold under the trade names Polygloss Cyan Blue and Polygloss Pro Magenta. Printing with these inks was done on the aSFL materials described above using a hand proofer (220 lpi and 5.8 bcm pyramid cell) and results are reported in Table 4. As shown in Table 4, Sample No. 1 is a polymeric substrate that was Corona treated at 2.4 watt density and then topically treated with a treatment composition comprising PERMAX 200 via a Meyer rod technique at an add-on level of about 0.4 wt %. This material was then printed on with the same inks and at the same conditions as the control sample.

Sample No. 2 is similar to Sample No. 1 in terms of the material treatment (Corona treatment and treatment composition) but is printed on with similar solvent-based ink which contains about 20% less pigment by weight. Sample No. 2 still shows in print uniformity and vibrancy as Sample No. 1 and is still better than the control material which was printed on with a higher pigment load ink.

TABLE 4

| Crockfastness Data for Flexographically Printed Solvent-Based Inks | | | | |
|---|---|---|---|---|
| Code | Corona* | Primer* | inks | CR** |
| Control | no | no | Standard pigment load | 4 |
| 1 | yes | yes | Standard pigment load | 4.5 |
| 2 | yes | yes | 20% lower pigment load | 5.0 |

The results of Table 4 indicate that the treatment of the polymeric substrate prior to printing with solvent-based ink allows the polymeric substrate to achieve better print uniformity such as better graphics and quality, use less ink which results in cost savings, and improved ink adhesion and rub resistance shown through the crockfastness ratings.

Examples For Ink Jet (Digital) Printing

The following Table 5 shows the print treatment compositions and a control applied to the polymeric substrate in an amount of about 2 gsm. The polymeric substrate used in all of the trials shown in Table 5 was the aSFL described above.

TABLE 5

Treatment Compositions

| Primer Number | Treatment Composition | Crockfastness Rating |
|---|---|---|
| 1 | Permax 200 (20 wt %) | 4 |
| 2 | Permax 200 (20 wt %) + XAMA 7 crosslinker (1 wt %) Note: pH adjusted to 10.00 with ammonia | 5 |
| 3 | Permax 200 (20 wt %) Crodacel QM (2 wt %) Laponite XLG (1 wt %) XAMA 7 crosslinker (1 wt %) Note: pH = 5.6 initially pH adjusted to 10.00 with ammonia. | 5 |
| 4 | Permax 200 (3.3 wt %) Crodacel QM (1.67 wt %) EKA AZC 5800M (1.25 wt %) Polyplasdone INF-10 (2 wt %) | 4.5 |
| 5 | EKA SP AA20 (2 wt %) Crodacel QM (2 wt %) Polyplasdone INF-10 (2.5 wt %) EKAAZC 5800M (1.5 wt %) | 4.5 |
| 6 | Laponite XLG clay (2 wt %) | 3 |
| 7 | Calcium carbonate XC 4900 (2 wt %) | 2 |
| | Calcium carbonate XC 4900 (2 wt %) Crodacel QM (1 wt %) | 4 |
| 8 | EKA SP AA20 (2 wt %) Crodacel QM (2 wt %) EKAAZC 5800M (1.5 wt %) | 4.5 |
| 9 | Kymene 557 LX (0.5 wt %) Crodacel QM (0.7 wt %) Permax 200 (1.3 wt %) | 5 |
| Control | None | 1 |

As used above in Table 5, Permax 200 sold by Noveon of Cleveland, Ohio, is believed to be an alphatic polyether waterborne urethane polymer. XAMA 7 sold by Bayer Corporation of Pittsburgh, Pa., is believed to be a poly-functional aziridine crosslinker. Crodacel QM sold by Croda, Inc. of Parsippany, N.J., is believed to be a quaternary ammonium cellulose salt. Laponite XLG sold by Southern Clay, Inc. of Gonzales, Tex., is believed to be a hydrous sodium lithium magnesium silicate. EKA AZC 5800M sold by Akzo Nobel Inks of Rome, Ga. is believed to be an ammonium zirconium carbonate and functions as a crosslinker. Polyplasdone INF-10 sold by ISP of Wayne, N.J. is believed to be a polyvinyl pyrrolidone. EKA SP AA20 sold by EKA Akzo Nobel of Rome, Ga. is believed to be an ammonium salt of styrene-acrylic copolymer. Calcium Carbonate XC 4900 sold by OMYA Product Development of North America is believed to be a calcium carbonate slurry. Kymene 557 LX sold by Hercules of Wilmington, Del. is believed to be a cationic polyethylene imine epichlorohydrin.

The crockfastness rating value of 1 reported in Table 5 for the control polymeric substrate indicate that the ink has no affinity to adhere to the polymeric substrate. Also, on the control only, the rub test was performed on the underneath layer of the aSFL (the polyethylene film) because no ink accumulated on the outer layer of the aSFL (the polypropylene).

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

The invention claimed is:

1. A process for printing a pattern onto a polymeric material, comprising:

providing an outer cover laminate for an absorbent article, wherein the outer cover laminate comprises a nonwoven web and a breathable polymeric film, wherein the nonwoven web comprises a spunborid web, a meltblown web, or combinations thereof, and wherein the nonwoven web comprises hydrophobic polyolefin fibers;

coating a surface treatment directly on at least a portion of a surface of said nonwoven web, wherein the surface treatment comprises a polyurethane from about 1% to about 50% by weight of the surface treatment and a cellulosic compound derivatized with a quaternary ammonium group from about 0.1% to about 10% by weight of the surface treatment;

drying said surface treatment;

printing an ink composition directly onto said surface treatment; and incorporating the outer cover laminate into an absorbent article, the nonwoven web comprising an outer cover material for the absorbent article, the coated surface of said nonwoven web defining an exterior surface of the absorbent article, the printed ink composition being located on the exterior surface.

2. The process of claim 1, wherein the nonwoven web comprises a spunbond web.

3. The process of claim 1, wherein the nonwoven web comprises a meltblown web.

4. The process of claim 1, further comprising the step of functionalizing the nonwoven web prior to coating the surface treatment directly on at least a portion of the surface of the nonwoven web.

5. The process of claim 1, wherein the polyurethane comprises a nonionic polyurethane.

6. The process of claim 1, wherein the polyurethane comprises an aliphatic polyether waterborne urethane polymer.

7. The process of claim 1, wherein the surface treatment further comprises a crosslinking agent.

8. The process of claim 7, wherein the crosslinking agent comprises a poly-functional aziridine crosslinking agent.

9. The process of claim 1, wherein the ink composition is digitally printed onto the surface treatment.

10. The process of claim 1, wherein the ink composition is printed onto the surface treatment with a combination of digital and flexographic printing processes.

11. The process of claim 1, wherein the ink composition is an aqueous ink composition.

12. The process of claim 1, wherein the ink composition is flexographically printed onto the surface treatment.

13. The process of claim 1, wherein the surface treatment is applied to the nonwoven web in an amount from about 0.1% to about 20% of a basis weight of the nonwoven web.

14. The process of claim 1, wherein the breathable polymeric film comprises a polyolefin film.

15. A process for printing a pattern onto a polymeric material, comprising:

providing an outer cover laminate for an absorbent article, wherein the outer cover laminate comprises a nonwoven web and a breathable polymeric film, wherein the nonwoven web comprises a spunbond web, a meltblown web, or combinations thereof, and wherein the nonwoven web comprises hydrophobic polyolefin fibers;

coating a surface treatment directly on at least a portion of a surface of said nonwoven web, wherein the surface treatment comprises a non-ionic polyurethane from about 1% to about 50% by weight of the surface treatment and a cellulosic compound derivatized with a quaternary ammonium group from about 0.1% to about 10% by weight of the surface treatment, wherein the non-ionic polyurethane comprises an aliphatic polyether waterborne urethane polymer;

drying said surface treatment;

digitally printing an aqueous ink composition directly onto at least a portion of said surface treatment; and incorporating the outer cover laminate into an absorbent article, the nonwoven web comprising an outer cover material for the absorbent article, the coated surface of said nonwoven web defining an exterior surface of the absorbent article, the printed ink composition being located on the exterior surface.

16. The process of claim 15, further comprising the step of functionalizing the nonwoven web prior to coating the surface treatment directly on at least a portion of the surface of the nonwoven web.

17. The process of claim 15, wherein the surface treatment further comprises a crosslinking agent.

18. The process of claim 17, wherein the crosslinking agent comprises a poly-functional aziridine crosslinking agent.

19. The process of claim 15, wherein the surface treatment is applied to the nonwoven web in an amount from about 0.1% to about 20% of a basis weight of the nonwoven web.

20. The process of claim 15, wherein the surface treatment comprises the non-ionic polyurethane from about 1% to about 25% by weight of the surface treatment.

* * * * *